United States Patent [19]

Schmid et al.

[11] 3,995,681

[45] Dec. 7, 1976

[54] APPARATUS FOR APPLYING FLUX POWDER TO THE BATH LEVEL IN A CONTINUOUS CASTING MOLD

[75] Inventors: Markus Schmid, Zurich; Werner Bruderer, Wattwil, both of Switzerland

[73] Assignee: Concast AG, Zurich, Switzerland

[22] Filed: Feb. 28, 1975

[21] Appl. No.: 553,922

Related U.S. Application Data

[62] Division of Ser. No. 471,762, May 20, 1974.

[30] Foreign Application Priority Data

May 30, 1973 Switzerland ..... 7799/73

[52] U.S. Cl. ..... 164/154; 118/8

[51] Int. Cl.[2] ..... B22D 11/00; B22D 27/20

[58] Field of Search ..... 164/154, 252, 55, 4; 118/8

[56] References Cited

UNITED STATES PATENTS

| | | | |
|---|---|---|---|
| 1,958,893 | 5/1934 | Kintner et al. | 118/8 X |
| 3,650,311 | 3/1972 | Fritsche | 164/252 X |

*Primary Examiner*—Robert D. Baldwin
*Attorney, Agent, or Firm*—Werner W. Kleeman

[57] ABSTRACT

An apparatus for the application of a casting agent, such as flux powder, to the bath level of liquid metal in a continuous casting mold during continuous casting embodying at least one measuring element arranged above the bath level in the continuous casting mold and distributor means for the distribution of the flux powder onto the bath level. Conductor means operatively connect the measuring element with regulator means. There are also provided means for changing the conveyed quantity of flux powder, and conductor means for operatively connecting the regulator means with the means for changing the conveyed quantity of flux powder.

4 Claims, 3 Drawing Figures

APPARATUS FOR APPLYING FLUX POWDER TO THE BATH LEVEL IN A CONTINUOUS CASTING MOLD

CROSS-REFERENCE TO RELATED CASE

This application is a divisional of our commonly assigned, copending United States application Ser. No. 471,762, filed May 20, 1974.

BACKGROUND OF THE INVENTION

The present invention relates to a new and improved apparatus for applying or depositing flux powder or the like to the bath level of liquid metal within a continuous casting mold during continuous casting operations.

During the continuous casting of metals, typically steel, it is known to apply to the surface of the molten bath, in other words the bath level, within the mold a flux powder. The flux powder serves a number of different functions, namely to absorb non-metallic contaminants, as a lubricant between the walls of the mold and the cast strand, to prevent the oxidation of the steel and to maintain small the radiation of heat. In most instances, prior to casting, the flux powder is prepared in small heaps or piles at the mold covering. During casting the casting personnel or worker displaces the flux powder with the aid of suitable tools and depending upon requirements into the hollow mold compartment, i.e. onto the bath level. Consequently, at least one worker must be continuously present at the neighborhood of the continuous casting mold in order to insure for the proper application of the flux powder when needed. Since the flux powder lies around in an exposed condition oftentimes there are formed disturbing dust clouds of such powder.

According to a further solution which has been proposed in this particular field of technology the flux powder is stored in a container. At the lower end of the container there is arranged a conveying worm which transfers the flux powder into a mixing container. From that location the flux powder is entrained by a gas stream and blown through the agency of a stationary tube onto the bath level. In order to avoid excessive development of dust the tube is divided at its end and widened into a distributor. The applied quantity of flux powder is determined beforehand or accommodated to the momentary requirements by the operator during casting with the aid of a manual valve or equivalent structure.

Both proposals have been found to produce a highly irregular distribution of the flux powder over the entire region or surface area of the bath level. The uniformity of the distribution of the flux powder is markedly dependent upon the reliability and dexterity of the operator responsible for the application of the flux powder. Further difficulties can arise if there is present an unsuitable composition of the flux powder. Faulty distribution of the flux powder over the level of the bath leads to repeated surface defects, such as, for instance, longitudinal and transverse fissures or cracks or markedly pronounced oscillation marks.

SUMMARY OF THE INVENTION

Hence, it is a primary object of the present invention to provide an improved apparatus for the application of flux powder to the bath level of a continuous casting mold during continuous casting operations in a manner ensuring as efficacious distribution of the flux powder over the surface of the bath of metal as possible.

Another object of the present invention is directed to the provision of an improved apparatus for automatically monitoring and controlling the distribution of flux powder over the bath level of a metallic pool in a continuous casting mold, so that the tiring monitoring operations by the casting personnel no longer are required.

Now in order to implement these and still further objects of the invention, which will become more readily apparent as the description proceeds, the method aspects of this development contemplate measuring the distribution of the flux powder at the surface of the bath level by means of measuring elements, and as a function of the measurement results controlling the infeed of the flux powder and its distribution over the level of the bath.

When using this technique there is no longer required the presence of a monitoring operator for the infeed of the flux powder. Distribution of the flux powder always takes place with the desired accuracy, so that even at locations demanding increased consumption of flux powder no shortage arises. Thus, fewer surface defects appear at the cast strand. If the method aspects of the invention are employed in conjunction with an installation equipped with automatic regulation of the level of the metal pool in the casting mold, then the entire casting operation can proceed automatically.

During the start of casting the flux powder is applied to the level of the molten bath through the agency of one or a number of distributors. The number of distributors, from which there flows flux powder onto the bath level, is dependent upon the dimensions of the mold as well as the desired uniformity of distribution of the flux powder. Since the surface of the flux powder layer possesses a lower temperature than the bath level of the liquid steel in the mold, only a slight amount of light or heat radiates from such surface. If the layer of flux powder possesses adequate thickness and is uniformly distributed over the entire surface of the bath level there is produced a substantially uniform dark surface. If the layer is too thin at a given location then the liquid slag or, in fact, the liquid metal appears at the surface. Now if measuring elements, for instance radiation-sensitive measuring elements, are arranged at the region of the bath level, then it is thus possible to measure deviations from the desired or original surface. Using these measurement values it is then possible to control the infeed of flux powder to the bath level. This can occur in that the infed quantity of flux powder is varied, or that the distributor at the end of the infeed arrangement for the flux powder is shifted out of its momentary spatial position. Depending upon requirements it is even possible to carry out simultaneously both operations.

In the simplest situation a single measuring element is adequate if it monitors a decisive portion of the bath level or at least a characteristic location thereof. In the case of larger size molds it is, however, necessary to subdivide the surface of the bath level into a number of measurement fields or measurement zones or regions and to arrange at each such measurement zone one such measuring or measurement element. All of the measured values are then delivered to a primary regulator or control containing a number of internal regulating circuits. This primary regulator then reaches the decision whether a measured shortage in the flux powder should be eliminated by displacing one or more of the distributors, by changing one or more of the infed quantities of flux powder to the distributors or by conjointly carrying out both operations.

As explained above the invention is not only concerned with the aforementioned method aspects, but also relates to a new and improved construction of apparatus for the performance thereof, wherein a preferred exemplary embodiment of apparatus is manifested by the features that at least two measuring elements are arranged over the bath level, these measuring elements are connected via lines or conductors with a regulator. The regulator is connected in turn via conductors or lines with means for changing the position of the distributor for the flux powder, the distributor being coupled with distributor tubes or pipes. Further, the regulator is connected with means for changing the conveyed quantity of flux powder.

According to an advantageous manifestation of the invention there are used radiation-sensitive measuring or measurement elements.

The flux powder is stored in a supply container or the like. From the location of such container the flux powder arrives through the agency of a distributor tube at a quantity or volume regulating device and from that location, through the agency of a further tube or pipe, at the distributor from which location the flux powder departs and is deposited onto the bath level. This distributor can be advantageously positionally changed at the region of the surface of the bath level with the aid of a suitable position adjustment device. In order to control the displacements of the distributor there are provided at least two radiation-sensitive measuring elements which are operatively connected via a measuring line or conductor with a regulator. The number of measuring elements is dependent upon how many measurement zones or regions are to be monitored at the surface of the bath level. Equally the number of internal regulation circuits in the regulator is dependent upon the number of distributors and measuring elements. The regulator delivers adjustment values for one or a number of quantity regulating devices as well as for one or a number of position adjustment devices for the distributors. In each case there are present as many radiation-sensitive measuring elements as there are measuring zones at the surface of the bath level which are to be checked and monitored. The regulator is also operatively coupled with a control device with the aid of which there can be provided reference values for the flux powder quantities and for the determination of the starting position of the distributors as well as the course of the programs for different casting programs or operations.

According to a simplified advantageous embodiment of the invention having a number of exit or outlet locations for the flux powder, to deposit the same upon the bath level, the distributor tubes or pipes are assembled together into a collecting trough or equivalent structure, resulting in the possibility of conjointly changing the position thereof. This embodiment requires a smaller expenditure in regulators.

Also it is here to be mentioned that the method aspects of the invention as well as the exemplary embodiments of apparatus for the performance thereof are not solely limited to use with flux powder, rather it is possible to apply to the bath level other casting agents or auxiliary agents in granular or plastic form.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
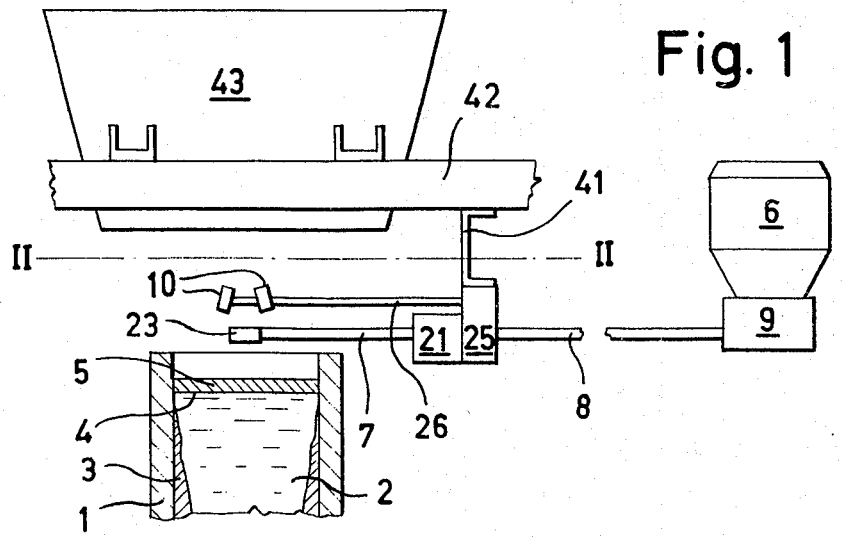
FIG. 1 schematically illustrates an arrangement for the infeed of a casting agent, such as for instance a flux powder, as well as showing the bath level region of a mold.

Describing now the drawings, it is to be understood that as a matter of convenience in illustration only enough of the components of the continuous casting installation have been shown so as to enable those skilled in the art to readily understand the underlying concepts of this development. Referring therefore more particularly to FIG. 1 there is illustrated therein the upper portion of a continuous casting mold 1. Liquid metal 2 is poured into the mold 1 from a tundish 43 or other intermediate vessel through the agency of a not particularly illustrated but conventional pouring device. Hence, as is well known, a solidified strand shell 3 forms within the continuous casting mold 1. At the surface of the metal pool in the mold, that is to say at the bath level 4 of the liquid metal, typically the liquid steel 2, in the mold 1 there is disposed a layer of a suitable casting agent, here typically a flux powder 5. The flux powder 5 drops out of a distributor 23 onto the bath level 4. The distributor 23 is operatively connected with a distributor tube or pipe 7, at the end of which there is located a position adjustment device 21. With the aid of this position adjustment device 21 the distributor 23 and the distributor tube 7 can be moved over a certain region. At the position adjustment device 21 there is also located a quantity or volume regulating device 25, with the aid of which there can be determined or regulated the quantity of flux powder in the distributor tube 7. The quantity regulating device 25 is operatively connected through the agency of a further distributor tube or pipe 8 with a supply container 6 for the flux powder. This supply container 6 can be located, for instance, at the tundish carriage 42 or at another type of support for the tundish 43. If a limited amount of space is available at the region of the tundish 43 then it is recommended to arrange such container 6 at a greater distance from the mold. Measuring or measurement elements 10 are mounted at a support 26 over the bath level 4. The measuring elements 10 are advantageously radiation-sensitive measuring elements, which for instance are sensitive to light- or thermal radiation. Each measuring element 10 is associated with a predetermined measuring zone or field at the surface of the bath level 4. If control of the bath level occurs by means of ultrasonic energy, then, such can also be used for measuring the covering of the bath level and appropriate components can form the measuring elements 10.

Figure 2:
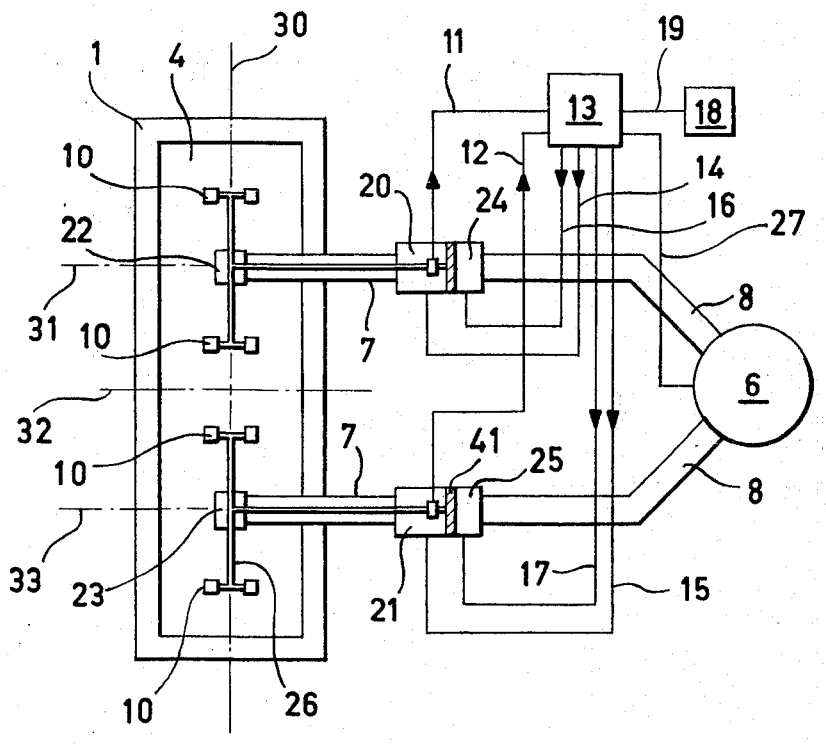
FIG. 2 is a plan view, substantially along the section line II—II of FIG. 1, portraying the infeed means for the casting agent as well as schematically illustrating the regulating system or apparatus.

Further details of the invention will be apparent by referring to FIG. 2. The surface of the bath level 4 surrounded by the continuous casting mold 1 is subdivided into eight measuring zones or fields by the lines 30, 31, 32 and 33. Operatively associated with each such measuring field is a measuring element 10. In the illustrated exemplary embodiment there are provided two flux powder distributors 22, 23, wherein each such distributor is dimensioned for the delivery of flux powder to four respective measuring zones or fields. At the start of the casting operation the distributor 22 is located at the point of intersection of the lines 30 and 31 and the distributor 23 at the point of intersection of the lines 30 and 33. The liquid metal flows through a pouring opening from the tundish 43 into the mold and specifically at the point of intersection of the lines 30 and 32. Basically each of the distributors 22, 23 is intended to serve for the covering of one-half of the surface of the bath level 4 with flux powder. Since one-half of the surface of the bath level 4 is divided into four measuring zones or fields there is associated with each of the distributors 22, 23, four respective measuring elements 10, each such measuring element 10 monitoring one of the four measuring zones. The measuring elements 10 are secured to a support or carrier 26 which is stationary during the casting operation.

The actual values of the covering of the bath level 4 with flux powder 5, determined by the measuring elements 10, are delivered via the conductors or lines 11, 12 to a regulator 13. This regulator 13 constitutes the primary component of a regulating system, as the same has been schematically shown in FIG. 2. The regulator 13 delivers adjustment magnitudes for the position adjustment devices 20, 21, the quantity regulating devices 24, 25 and the primary quantity regulator 9 at the supply container 6. For this purpose there are provided the conductors or lines 14, 15, 16, 17 and 27. The regulator 13 is coupled through the agency of a connection line 19 with a control device 18. By means of this control device 18 all of the reference values as well as possible program courses or schedules for the infeed of flux powder during the casting process are introduced into the regulator 13. This control device 18 also controls for instance the starting positioning of the distributors 22, 23 as well as the command for the point in time where there should begin the deposit of flux powder at the bath level 4 and can thus further be coupled with the automatic bath level regulator.

If there is now considered one of both distributors 22, 23 then for instance there can be ascribed to the distributor 22, by way of example, the following mode of operating of the flux powder infeed arrangement. If the radiation of one of the surfaces enclosed by the lines 30, 31 and 32 is greater than that of the remaining other three surfaces, then this is determined by the measuring element 10 intended to monitor such surface. The deviating measuring signal is delivered via the conductor or line 11 to the regulator 13. The regulator 13 delivers an adjustment value or adjustment signal via the conductor or line 14 to the position adjustment device 20 which ensures that the distributor 22 will be shifted into the required measuring zone or field enclosed by the lines 30, 31 and 32, so that there is delivered thereto more flux powder than previously. If there is also determined at a second measuring zone or field surrounded by the lines 30, 31 and 32 a deficiency in flux powder, then the distributor 22 is moved along the line 30 in the direction of the center of the mold. However, if the measurement results determine that at two diagonally opposite fields or in all four fields there is a deficiency of flux powder, then the regulating device 13 ensures that the distributor 22 assumes a position, which is dependent upon the measurement values of the four measuring elements, and simultaneously delivers via the conductor or line 16 an adjustment value for the quantity of flux powder to the quantity regulating device 24. Consequently, as a function of the measurement values the position of the distributor 22 as well as the quantity of flux powder flowing out of such distributor 22 is altered. The distributor 23 carries out the same mode of operation for the other half of the mold. If the required change in the quantity of flux powder exceeds the control or influence range of the quantity regulating devices 24 and 25, then the regulator 13 delivers via the conductor or line 27 adjustment values to the feed or conveying device 9 of the supply container 6. Consequently, it is possible to prevent the presence of a deficiency in the infeed of the flux powder or that the distributor tubes 8 will clog.

In the case of large cross-sectional shapes of the strand to be cast there are required more than two distributors. However, in this case there must also be amplified the regulation system containing the regulator 13 and all of the other regulation equipment. In contrast thereto in the case of smaller strand shapes or sizes it can be sufficient if there is only provided one measuring element 10 and one distributor. If one measuring element 10 is used then the regulation of the delivery of the flux powder is limited to simply regulating the quantity of flux powder, since positioning of the distributor can only be undertaken with equipment provided with at least two measuring elements 10.

Figure 3:
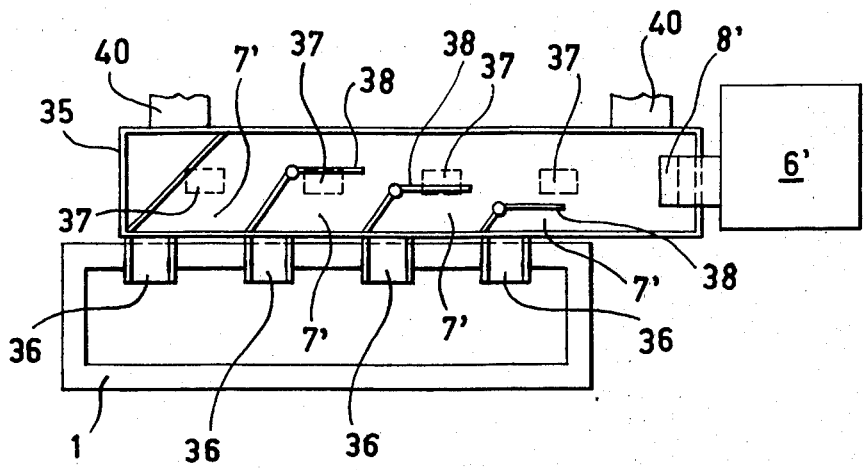
FIG. 3 is a plan view of an infeed arrangement for a casting agent with the distributor channels assembled or grouped together and with the upper covering removed.

Now in the variant embodiment depicted in FIG. 3 there are grouped together four distributor tubes or pipes 7' into a collecting trough 35 or the like. An outlet channel 36, a quantity regulating device 38 as well as a conveying or feed vibrator 37 is associated with each distributor tube component 7'. The collecting trough 35 is equipped with a not particularly shown covering during the operation, at which there can be arranged at least two radiation-sensitive or radiation-responsive measuring elements for monitoring the delivery of the flux powder. The flux powder is stored in a storage or supply container 6', this supply container 6' is connected with the tundish carriage 42. At the lower end of the supply container 6' there is arranged a dosing device, with which there is connected a primary distributor pipe or tube 8'. By means of this tube 8' the flux powder is conveyed into the collecting trough 35 and from that location via the distributor tubes or pipes 7' and the outlet channels 36 introduced into the mold 1. The collecting trough 35 is secured via the support or carrier 40 at the tundish carriage 42. The securing means for attaching the carrier 40 to the tundish carriage 42 is equipped with displacement devices permitting changing the position of the trough 35 during operation. Consequently, it is possible to change the position of the collecting trough 35 with respect to the bath level, so that there can be controlled the distribution of the flux powder at the bath level in addition to the quantity of flux powder. In the event that not too great accuracy requirements are placed upon the distribution of the flux powder on the surface of the bath level, then this solution permits of a saving in the mechanical components and regulating devices.

It is also possible to mount the distributors 22, 23 and the distributor tubes 7, 8, 7' as well as the supply container 6 at a device which is separate from the tundish carriage 42. Also the vibrators 37 can be replaced by a conveying worm or the like, as such structure is well known in the material conveying or handling art.

While there is shown and described present preferred embodiments of the invention, it is to be distinctly understood that the invention is not limited thereto but may be otherwise variously embodied and practiced within the scope of the following claims. Accordingly,

What is claimed is:

1. An apparatus for depositing a casting agent, such as flux powder, to the bath level of liquid metal in a continuous casting mold during continuous casting, for monitoring the even distribution of a given layer thickness of said casting agent on said bath level of liquid metal, and for automatically correcting any deficiency in said distribution, comprising means for delivering said casting agent, means supplying and conveying the casting agent to the delivering means, at least two measuring element means fixedly arranged above the bath level in the continuous casting mold for generating signals indicative of the thickness of the layer of casting agent, said delivering means including distributor means for the distribution of the casting agent, said distributor means being equipped with distributor tube means, regulator means for said distributor means for influencing the position of said distributor means and the quantity of casting agent delivered by said distributor means, first conductor means operatively connecting said measuring element means with said regulator means, means for the adjustment of the position of said distributor means, second conductor means operatively connecting said regulator means with said position adjustment means for the distributor means, means for changing the conveyed quantity of casting agent, and third conductor means for operatively connecting the regulator means with said means for changing the conveyed quantity of casting agent.

2. The apparatus as defined in claim 1 wherein said measuring element means comprise radiation-sensitive measuring elements.

3. The apparatus as defined in claim 1, further including a control device for furnishing reference values relative to the delivery of casting agent to the regulator means, and a connection line for connecting the regulator means with said control device.

4. An apparatus for depositing a casting agent, such as flux powder, to the bath level of liquid metal in a continuous casting mold during continuous casting, for monitoring the even distribution of a given layer thickness of said casting agent on said bath level of liquid metal, and for automatically correcting any deficiency in said distribution, comprising measuring means arranged above the bath level in the continuous casting mold for generating signals indicative of the thickness of the layer of casting agent, distributor means for the distribution of the casting agent onto the bath level, means connected to said distributor means for adjusting the position of the distributor means, regulator means for said distributor means for influencing the position of said distributor means and the quantity of casting agent delivered by said distributor means onto the bath level, means operatively connecting said regulator means with said adjusting means, first conductor means operatively connecting said measuring means with said regulator means, means for changing the conveyed quantity of casting agent, and second conductor means operatively connecting the regulator means with said means for changing the conveyed quantity of casting agent.

* * * * *